United States Patent [19]

McGowan

[11] Patent Number: 4,524,873

[45] Date of Patent: Jun. 25, 1985

[54] METHOD AND APPARATUS FOR DISASSEMBLING SECTIONAL BOOM OF TOWER CRANE AT TERMINAL HEIGHTS

[75] Inventor: Joseph L. McGowan, Harpenden, England

[73] Assignee: The Marley Cooling Tower Company, Mission, Kans.

[21] Appl. No.: 444,743

[22] Filed: Nov. 26, 1982

[51] Int. Cl.[3] ..... B66C 17/04

[52] U.S. Cl. ..... 212/177; 212/211; 414/560; 29/426.3

[58] Field of Search ..... 29/426.3, 426.1, 431; 212/175–177, 182, 187, 188, 194, 211, 224, 266, 267; 414/467, 497, 543, 560; 182/128

[56] References Cited

U.S. PATENT DOCUMENTS

| | | | |
|---|---|---|---|
| 1,614,697 | 1/1927 | Snook | 414/467 |
| 2,941,674 | 6/1960 | Bille | 212/194 |
| 2,958,940 | 11/1960 | Murphy | 29/431 |
| 3,426,914 | 2/1969 | Waleson et al. | 212/177 |
| 3,789,565 | 2/1974 | Lindholm | 212/176 |
| 4,064,615 | 12/1977 | Andersson | 212/177 |

FOREIGN PATENT DOCUMENTS

| | | | |
|---|---|---|---|
| 1403907 | 11/1965 | France | 212/176 |
| 639778 | 5/1962 | Italy | 212/176 |

*Primary Examiner*—Galen L. Barefoot
*Assistant Examiner*—Stephen P. Avila
*Attorney, Agent, or Firm*—Schmidt, Johnson, Hovey & Williams

[57] ABSTRACT

An apparatus for the safe, cost-efficient disassembling of a sectionalized tower crane boom is provided that enables disassembling of the boom while the boom is at terminal heights. The disassembling apparatus includes a working platform that may be detachably coupled to an inboard boom section, a pair of independently controlled jibs for lifting and supporting the outermost boom section, and a supporting structure and puller hoist for shifting the position of a detached boom section to a position wherein the center of gravity of the detached section may be generally vertically aligned with the center of support for the disassembling apparatus. Vertical alignment of the disassembling apparatus' and the detached boom section's centers of gravity is provided to assure safe and stable lowering of the apparatus and detached boom section.

7 Claims, 12 Drawing Figures

METHOD AND APPARATUS FOR DISASSEMBLING SECTIONAL BOOM OF TOWER CRANE AT TERMINAL HEIGHTS

BACKGROUND OF THE INVENTION

1. Field of the Invention

This invention relates to disassembling apparatus for sectionalized tower crane booms. More particularly, it is concerned with a disassembling apparatus that may be connected to a tower crane boom for dismantling of the boom while the boom is maintained at an elevated position.

2. Description of the Prior Art

Buildings and related structures are commonly constructed with the use of modular tower cranes. It is common to construct the structure around the mast of the crane so that building materials lifted by the boom of the crane may be readily delivered to any point of the structure being constructed. The centering of a tower crane within the structure being constructed, however, makes it impossible to lower the boom of the crane to ground level for dismantling of the boom once the structure is completed.

Heretofore, disassembly of modularized boom sections of tower cranes has been accomplished with the use of helicopters, or through the use of disassembling equipment that is hoisted to the boom and supported by an inboard section of the boom while the outermost section of the boom is lifted by the disassembling equipment. Disassembly of a boom through the use of helicopters is costly and dangerous, and must be accomplished by a skilled crew that can hook cables extending from the helicopter to a boom section while the helicopter hovers over the boom. Connection of the helicopter cables to the boom section, and the disconnecting of the outermost boom section from the inboard sections of the boom must be accomplished during a limited time interval, since the excessive fuel consumption of a helicopter while hovering precludes hovering of the helicopter for extended periods.

Conventional disassembling equipment designed to be supported by inboard boom sections for lifting the outermost boom section of a tower crane has required the use of counterweights to balance the weight of the outermost boom section once it is detached from the inboard boom sections. The operator of the disassembling equipment must correctly determine the weight of the boom section to be detached, and must select a counterweight of a corresponding weight. Moreover, conventional disassembling equipment has not included means for rotating the outermost boom section about its longitudinal axis, to make it possible to relieve sheer stresses across the pin connecting adjacent boom sections. The above described deficiencies have in the past resulted in dismantled boom sections pivoting uncontrollably about disassembling equipment due to the misplacement or wrong selection of counterweights, and in the need for applying excessive force to remove the pin connecting adjacent boom sections.

A disassembling apparatus for sectionalized tower crane boom sections that would stably support a disconnected boom section without the need for counterweights, and which would rotate the outermost boom section of a tower crane about its longitudinal axis to facilitate the removal of pins connecting adjacent boom sections would be a decided advantage.

SUMMARY OF THE INVENTION

The problems outlined above are in large measure solved by the method and apparatus of the present invention for disassembling sectionalized tower crane booms. That is to say, the apparatus hereof includes means for shifting the center of gravity of a detached boom section into generally vertical alignment with the disassembling apparatus thereby precluding the requirement for the use of counterweights of a size to balance the detached boom section, and includes means for rotating the outermost boom section about its longitudinal axis.

The disassembling equipment hereof broadly includes a load-bearing framework, couplings for detachably connecting the framework to an inboard boom section, a pair of spaced apart jibs for supporting the outermost boom section, a lowermost cradle for receiving a detached boom section, and a cable and pulley arrangement for shifting the position of a detached boom within the cradle to a point wherein the center of gravity of the detached boom section is generally vertically aligned with the center of gravity of the disassembling apparatus.

DETAILED DESCRIPTION OF THE DRAWINGS

Figure 8:
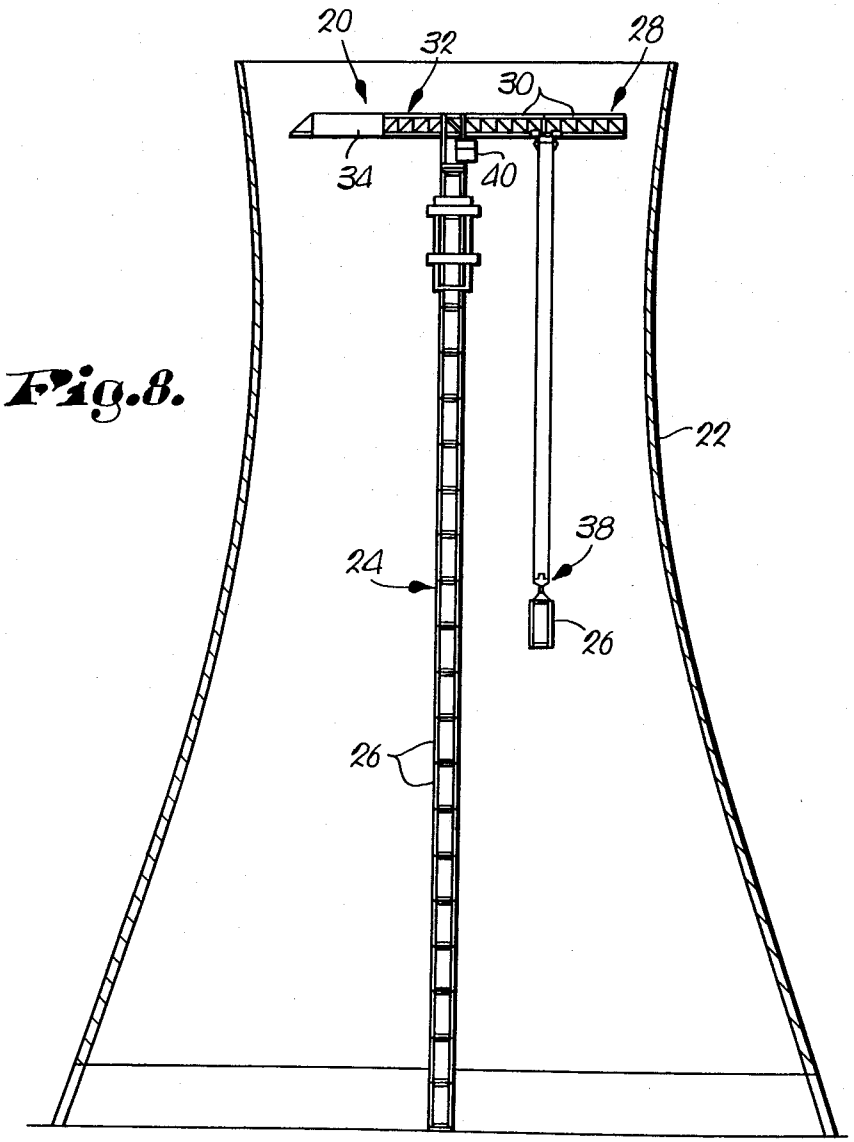
FIG. 8 is a vertical sectional view of a finished hyperbolic cooling tower centered about a tower crane having a disassembled boom.
Figure 1:
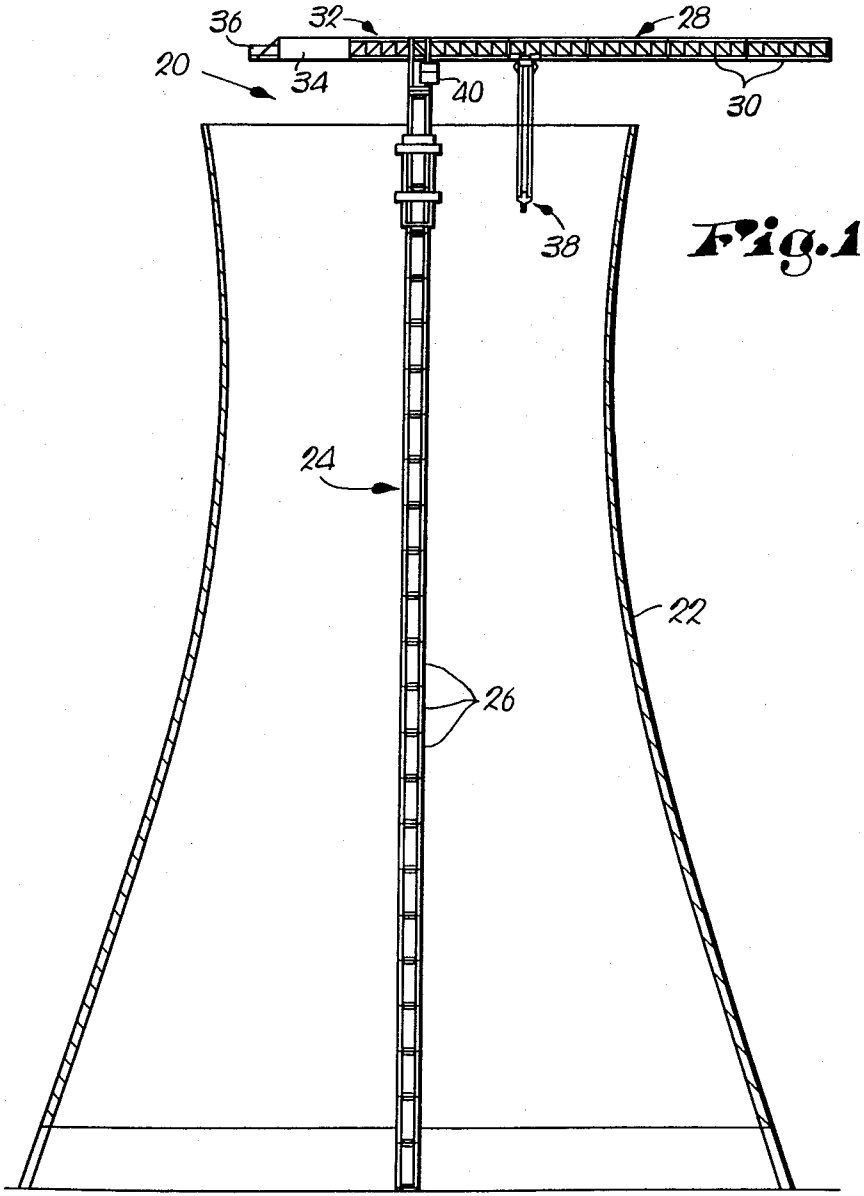
FIG. 1 is a vertical section of a finished hyperbolic cooling tower centered around a tower crane used in construction of the tower.

Referring to the drawings, a modular tower crane is depicted in FIGS. 1 and 8 in conjunction with a hyperbolic cooling tower 22 constructed with the use of crane 20. The crane 20 broadly includes a mast 24 comprised of individual mast sections 26, a boom 28 comprised of individual boom sections 30, a counterboom 32 including a machinery space 34 and counterweight 36, a hoisting assembly 38, and a control console 40.

Figure 2:
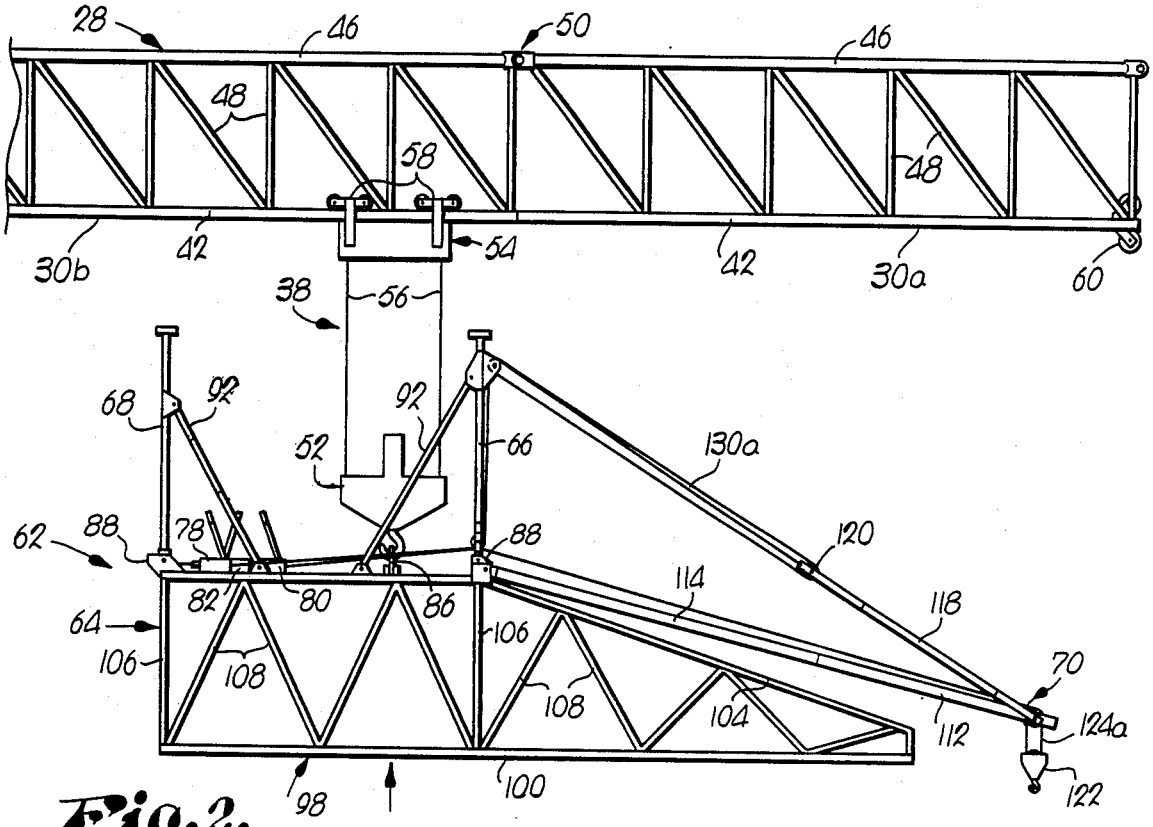
FIG. 2 is an enlarged view of the end of a tower crane boom with a disassembling apparatus in accordance with the present invention suspended therefrom.
Figure 3:
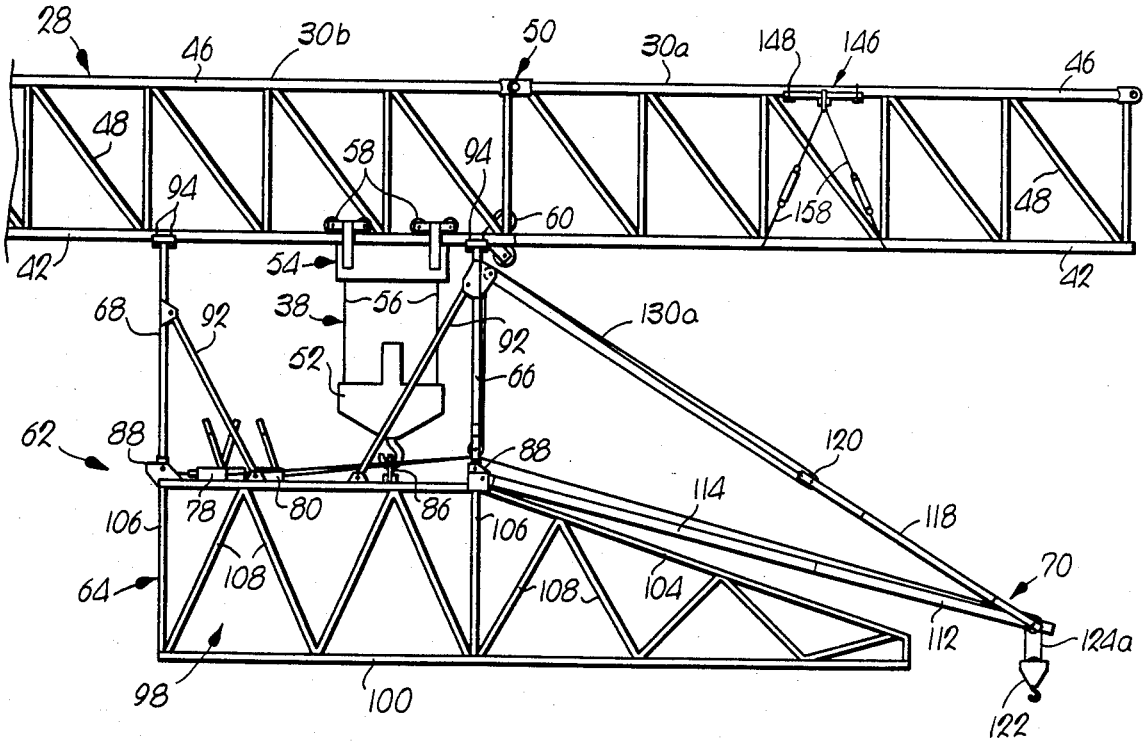
FIG. 3 is a view similar to FIG. 2 but depicts the disassembling apparatus rigidly connected to the boom.
Figure 4:
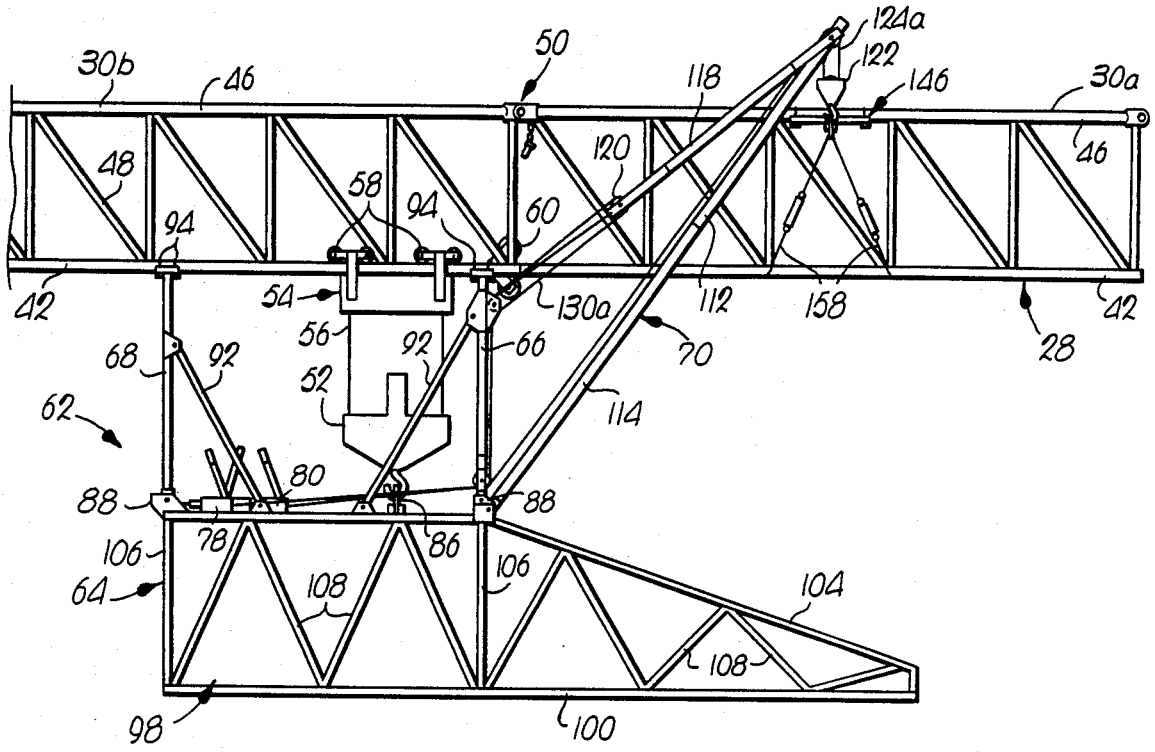
FIG. 4 is similar to FIG. 3 but depicts the jibs of the disassembling apparatus in a raised position and connected to the outermost boom section.

The boom sections 30 are triangular in cross section and include a pair of spaced apart, parallel, lowermost tubular members 42, 44, and a single, uppermost tubular member 46. The tubular members 42, 44, 46 are interconnected by a plurality of strength elements 48. As best seen in FIGS. 2–4, the outermost boom section 30*a* and next inboard boom section 30*b* are interconnected at their upper tubular members 46 by pin and clevis assembly 50. The lower tubular members 42, 44 of boom section 30*a* include a pilot (not shown) that is telescopically received within the lower tubular members 42, 44 of inboard boom section 30*b*.

Hoisting assembly 38 includes hook assembly 52 suspended from a carriage 54 by cables 56. Carriage 54 includes rollers 58 that track along the lower tubular members 42, 44 of boom sections 30. The carriage 54 is connected by a cable (not shown) to the machinery room via sheaves 60.

The disassembling apparatus 62 in accordance with the present invention broadly includes a load-bearing framework 64, fore and aft pairs of struts 66, 68 pivotally connected to and extending upwardly from the framework 64, and a pair of jibs 70, 72.

Framework 64 supports a working platform 74. A plurality of puller hoists 76, 78, 80, 82, 84 are located on the working platform 74, as is hoist assembly connecting lug 86. Strut pairs 66, 68 are pivotally connected to the working platform 74 at flanges 88. Diagonally oriented support rods 92 hold the strut pairs 66, 68 in upright position. The support rods 92 may be held in position by either removable cotter pins or nut and bolt assemblies. Referring to FIGS. 2–6, the strut pairs 66, 68 are rigidly connected to the boom section 30*b* by detachable U-bolts 94.

Figure 9:
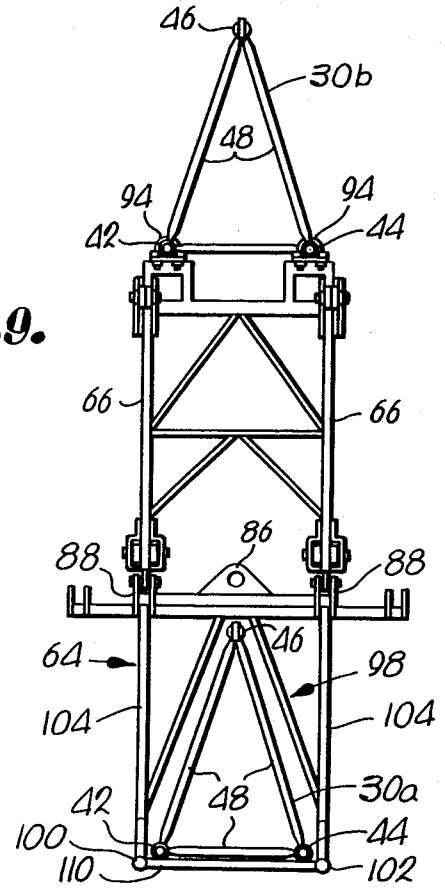
FIG. 9 is an end elevational view of the disassembling equipment in accordance with the present invention attached to a tower crane boom with the jibs removed for clarity, and having the outermost boom section of the boom stored within the disassembling equipment.
Figure 10:
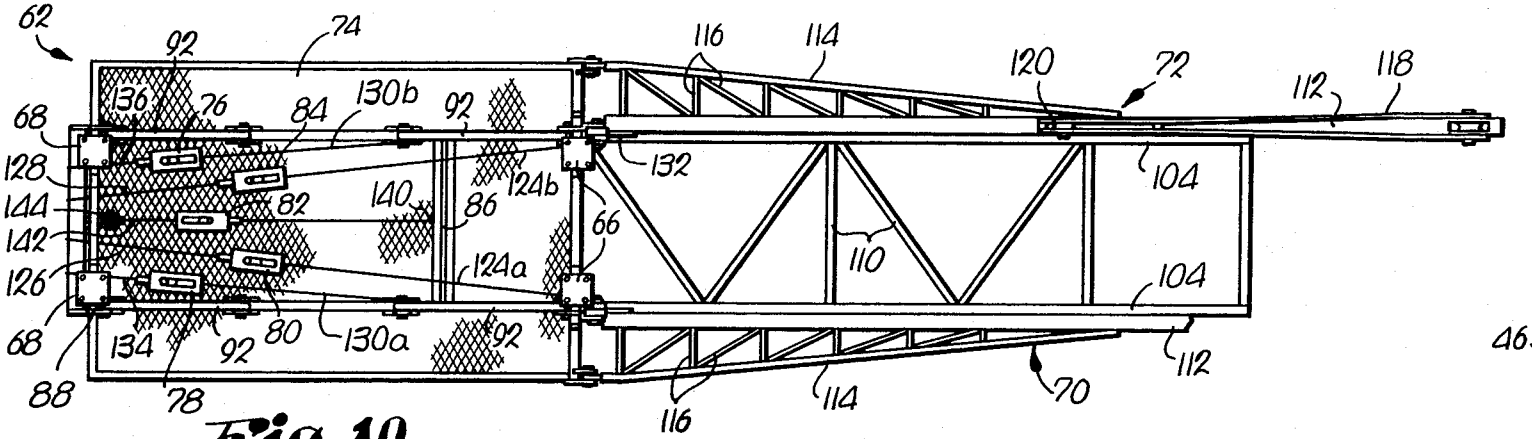
FIG. 10 is a plan view of the disassembling equipment in accordance with the present invention with one jib removed for clarity.
Figure 12:
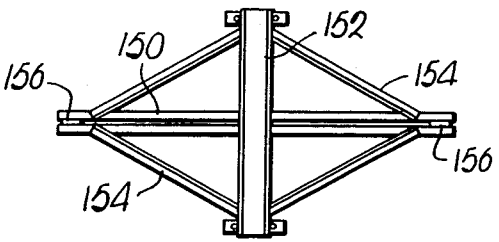
FIG. 12 is a plan view of a spreader bar.
Figure 11:
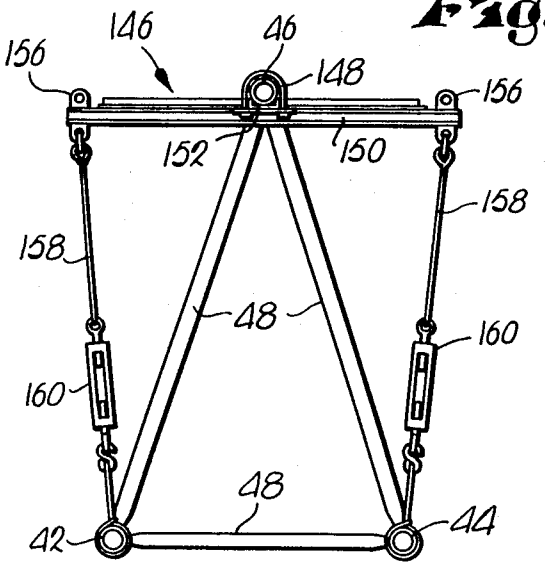
FIG. 11 is a vertical sectional view of the outermost boom section of a tower crane with a spreader bar attached thereto.

Framework 62 defines boom section receiving cradle 98 lowermost of the working platform 74. Cradle 98 includes lowermost, generally parallel, spaced-apart tracks 100, 102. Tracks 100, 102 advantageously include an upper surface comprised of a low friction material such as polypropylene. Alternatively, the tracks may be provided with roller. The tracks 100, 102 extend from a point vertically aligned with the rear struts 68 to a point well forward of the forward struts 66. Diagonal supporting pieces 104 extend forwardly and downwardly from the working platform 74, and the tracks 100, 102 are rigidly suspended from the platform and respective supports 104 by a plurality of vertically oriented braces 106 and diagonally oriented braces 108. As best depicted in FIGS. 9 and 10, the two tracks 100, 102 are interconnected by a plurality of cradle floor defining braces 110. The two tracks 100, 102 are spaced apart a width that is only slightly greater than the width at which boom section lower tubular members 42, 44 are spaced apart.

Jibs 70, 72 each include a main member 112, and a lateral support member 114. The main member 112 and support member 114 of each jib 70, 72 are pivotally connected, at spaced apart points, to the working platform 74. Support braces 116 interconnect each main member 112 with its respective support member 114. A bifurcated yoke 118 is pivotally connected to the outermost end of each main member 112. Each yoke 118 includes a pulley 120 at its end spaced apart from the end pivotally connected to its respective main member 112. A block and tackle assembly 122 with a depending hook is suspended from each jib 70, 72 by wire 124.

Wire 124*a* extends from the block and tackle assembly of jib 70 to puller hoist 80. Puller hoist 80 is anchored to working platform 74 by wire 126. Wire 124*b* extends from the block and tackle assembly of jib 72 to puller hoist 84. Puller hoist 84 is anchored to working platform 74 by wire 128. The pulley of the bifurcated yoke of jib 70 is connected to puller hoist 78 by a wire 130*a* and the pulley of the bifurcated yoke associated with jib 72 is connected to puller hoist 76 via line 130*b*. Puller hoists 78, 76 are anchored to the working platform 74 by wires 134, 136 respectively. Puller hoist 82 is anchored to the working platform 74 by a wire 142 at connection point 140. Wire 142 extends from the puller hoist 82, around pulley 144 and underneath the working platform 74.

A spreader bar 146 may advantageously be connected to the upper tubular member 46 of the outermost boom section 30*a* by detachable U-bolts 148. The spreader bar 146 includes a main member 150, a cross member 152, and a plurality of support members 154 interconnecting the main member and cross member. Apertured connection elements 156 are positioned at opposed ends of the main member 150. A pair of guy wires 158 extend between respective connection elements 156 and lowermost boom section tubular members 42, 44. Each guy wire 158 includes an adjustable turnbuckle 160.

Operation of the disassembling apparatus 62 will now be described with reference to FIGS. 2 through 7 which illustrate an operational sequence.

Referring to FIG. 2, the disassembling apparatus 62 is depicted connected to the hoist assembly 38 of tower crane 20. Jibs 70, 72 are in a lowered position, thereby positioning the center of gravity of the disassembling apparatus 62 directly below connecting lug 86.

Referring to FIG. 3, the disassembling apparatus 62 is depicted raised to a position immediately below main section 30*b* and immediately inboard of outermost boom section 30*a*. Struts 66, 68 are rigidly connected to the boom section 30*b* by detachable U-bolts 96. Sheaves 60 have been relocated from the outermost boom section 30*a* to the next inboard section 30*b*. Also referring to FIG. 3, it will be noted that spreader bar 146 has been attached to the outermost beam section 30*a* at approximately the center point of the boom section 30*a*. The next step in the operation, and referring to FIG. 4, is the raising of jibs 70, 72 by operation of puller hoists 78, 76. Once the jibs 70, 72 are in position, the respective hooks of the jib block and tackle assemblies 122 are connected to the connection elements 156 of spreader bar 146, and the weight of the outermost beam section 30*a* is transferred to the framework 64 of the apparatus 62 by further raising the jib 70, 72.

As is apparent from FIG. 10, each jib 70, 72 may be independently raised and lowered by its respective puller hoist 78, 76, and each hoist 122 may also be independently raised and lowered by its respective puller hoist 80, 84. In this manner, the outermost boom section 30*a* may be rotated about its longitudinal axis, thereby relieving sheer forces that may be transmitted across the pin of the pin and clevis assembly 50 interconnecting the outermost boom section 30*a* with the next inboard section 30*b*. The pin may be easily removed once the sheer stresses across it are relieved, and the boom section 30*a* is thereby disconnected from the boom section 30*b* and supported by the framework 64 of apparatus 62. It will also be appreciated that the puller hoists 78, 76 may be manipulated to shift the outermost boom section 30*a* inwardly and outwardly as well as in an up and down motion.

Figure 5:
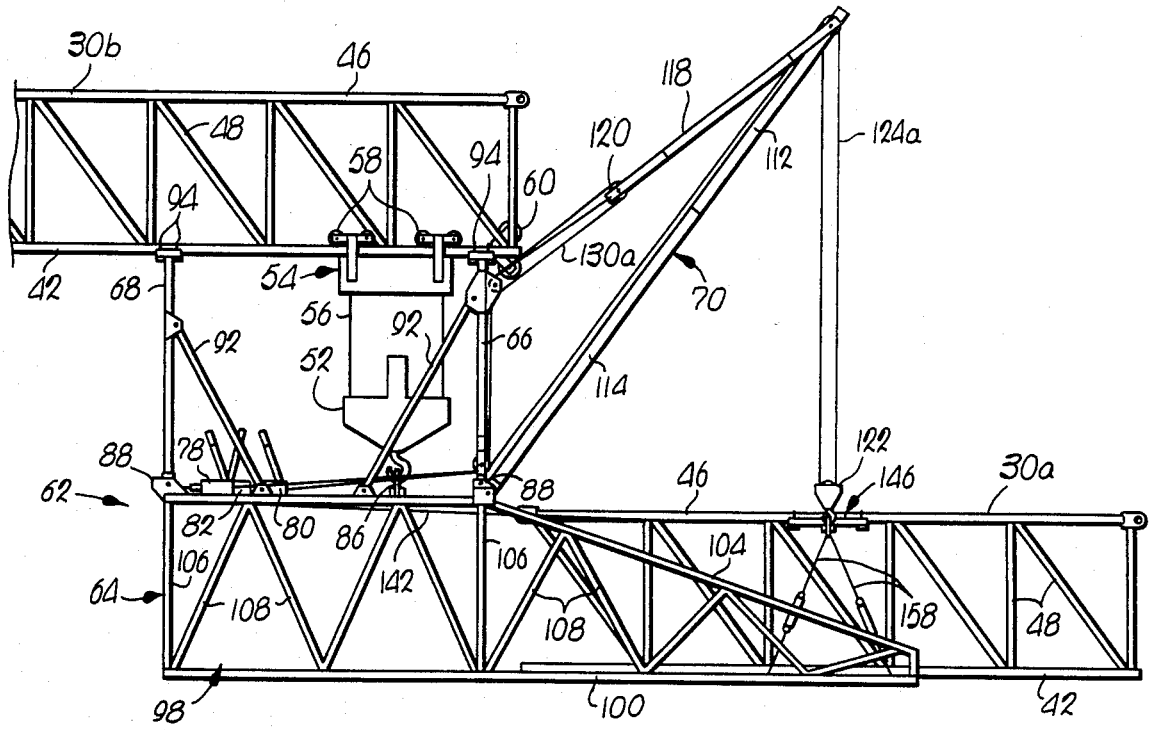
FIG. 5 is similar to FIG. 4 but with the outermost boom section lowered to the cradle of the disassembling apparatus.
Figure 6:
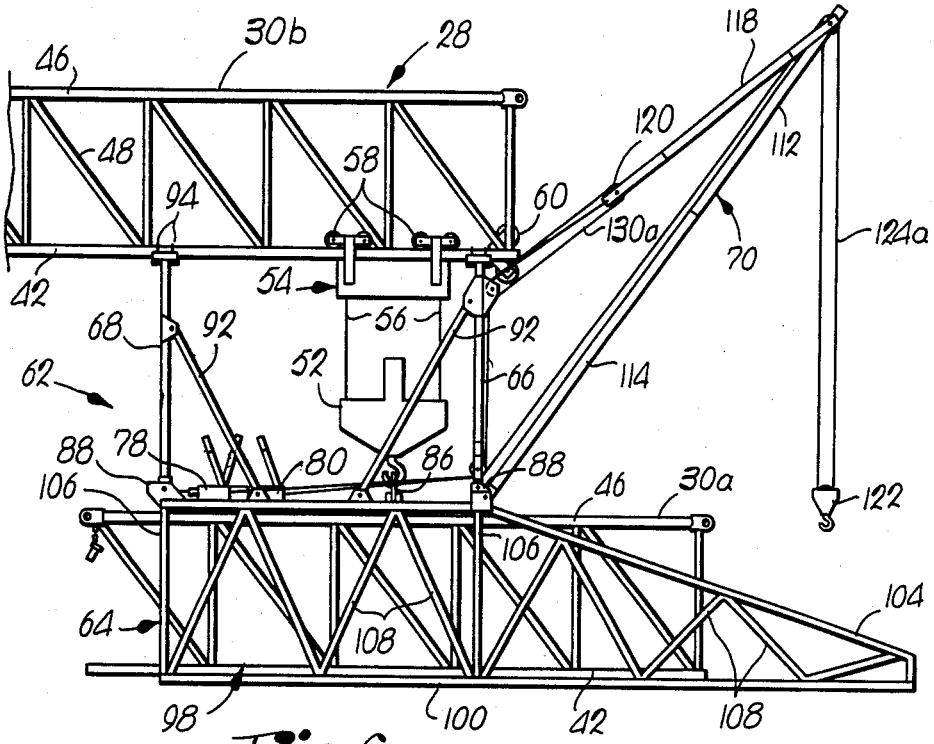
FIG. 6 is similar to FIG. 5 but with the detached boom section shifted to a position wherein its center of gravity is generally vertically aligned with the center of gravity of the disassembling equipment.

Referring to FIG. 5, the next step in the disassembly operation is the operation of puller hoists 80, 84 to lower the disconnected boom section 30*a* into the cradle 98 of apparatus 62. Wire 142 extending from puller hoist 82 is thereafter connected to boom section 30*a*, the spreader bar 146 is removed, and the boom section 30*a* is shifted relative to the apparatus 62 by operation of puller hoist 82 to a position wherein the center of gravity of the disconnected boom section 30*a* is generally vertically aligned with the center of gravity of the apparatus 62.

Figure 7:
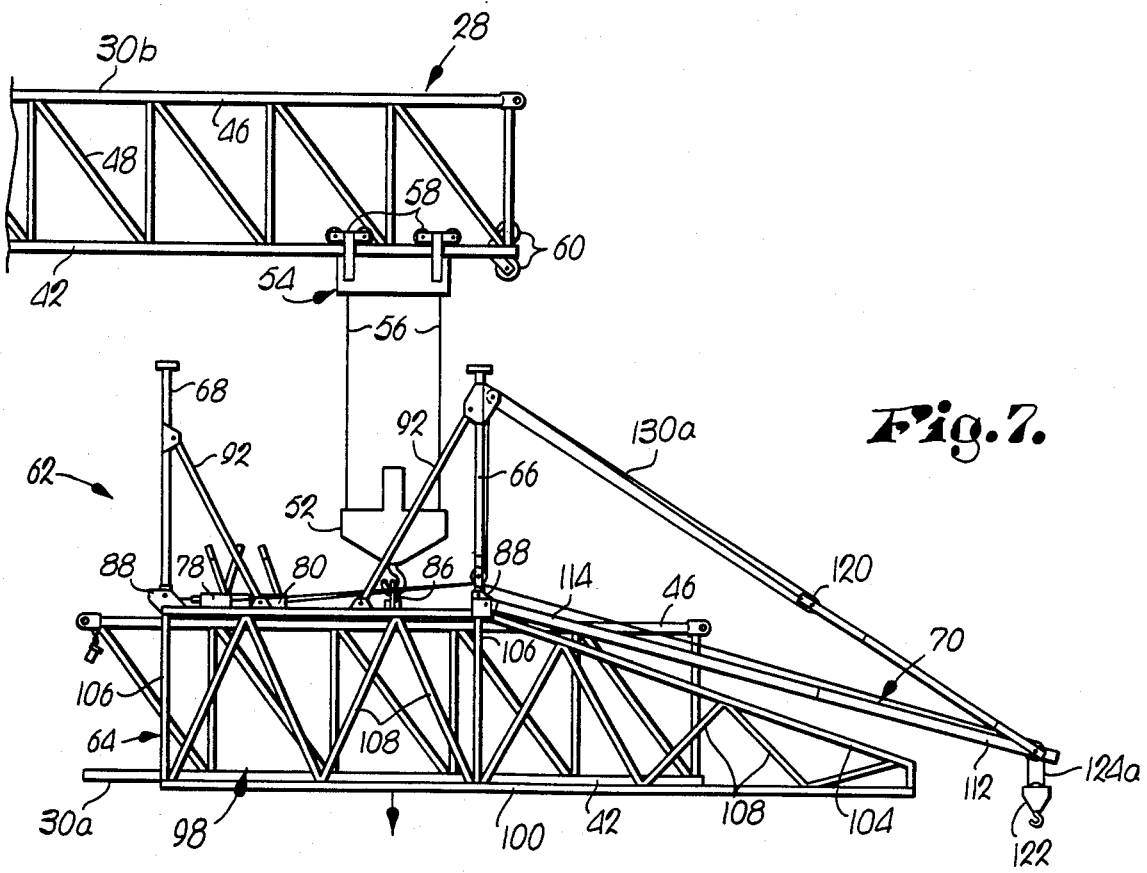
FIG. 7 is similar to FIG. 6, but with the disassembling apparatus and detached boom section suspended from the crane boom in a lowered position.

Referring to FIG. 7, the final steps in the operation are to lower the jibs 70, 72, disconnect the U-bolts 94 connecting the strut pairs 66, 68 to the boom section 30*b*, and lowering of the apparatus 62 and disconnected boom section 30*a* in unison. The apparatus 62 and disconnected jib section 30*a* will be maintained in a stable, normally horizontal orientation throughout the lowering operation, since the centers of gravity of the apparatus 62 and disconnected boom section 30*a* are in generally vertical alignment, beneath the connection lug 86.

I claim:

1. In apparatus for disassembling a tower crane boom having an outermost boom section, at least one inboard boom section, means detachably interconnecting said boom sections, and a hoisting assembly suspended from said boom, the combination therewith of:

an elongated load bearing framework;

means cooperable with said hoisting assembly for shiftably coupling said framework to said inboard boom section for movement along the length thereof with the longitudinal length of the framework extending generally horizontally;

jib means on said framework for transferring said outermost boom section to said framework for support thereby when the section is detached from the boom for supporting of said outermost section by said framework; and means on said framework for shifting said outermost section substantially horizontally relative to said framework to a position wherein the center of gravity of said outermost section is generally vertically aligned with the center of support of said framework by said hoisting assembly from said inboard boom section.

2. An apparatus as claimed in claim 1, said transferring means including a pair of jibs pivotally mounted to said framework and means operably coupled to said jibs for raising and lowering of said jibs.

3. An apparatus as claimed in claim 2, said raising and lowering means including means for raising and lowering each of said jibs independently of each other.

4. An apparatus as claimed in claim 1, including means operably coupled to said framework for shifting the vertical orientation of said framework relative to said boom.

5. An apparatus as claimed in claim 1, said coupling means including means for rigidly securing said framework to said boom section.

6. An apparatus as claimed in claim 5, said securing means being detachable.

7. An apparatus as claimed in claim 1, said framework including a transversely U-shaped upwardly opening, horizontally extending cradle for receiving and supporting said outermost section.

* * * * *